US005236188A

United States Patent [19]

Breton et al.

[11] Patent Number: 5,236,188

[45] Date of Patent: Aug. 17, 1993

[54] APPARATUS AND METHOD FOR DELIVERING PRINTED PRODUCTS IN A ROTARY PRINTING PRESS

[75] Inventors: Richard E. Breton; Mark A. Wingate, both of Rochester, N.H.

[73] Assignee: Heidelberg Harris, Inc., Dover, N.H.

[21] Appl. No.: 937,928

[22] Filed: Aug. 31, 1992

[51] Int. Cl.[5] ..... B65H 29/00

[52] U.S. Cl. ..... 271/187; 271/315; 101/232

[58] Field of Search ..... 101/232, 216; 271/187, 271/315, 11, 204; 270/58

[56] References Cited

U.S. PATENT DOCUMENTS

| | | | |
|---|---|---|---|
| 1,363,031 | 12/1920 | Wood | 271/315 |
| 2,121,327 | 6/1938 | Quick et al. | 271/315 |
| 3,116,668 | 1/1964 | Novick | 271/187 |
| 3,531,108 | 9/1970 | Rabinow et al. | 271/187 |
| 4,736,936 | 4/1988 | Hertel et al. | 270/58 |
| 4,801,132 | 1/1989 | Reist | 271/187 |
| 5,000,437 | 3/1991 | Schweider et al. | 271/187 |
| 5,028,045 | 7/1991 | Müller | 271/187 |
| 5,046,711 | 9/1991 | Merwarth et al. | 271/315 |
| 5,110,108 | 5/1992 | Müller | 271/315 |
| 5,156,389 | 10/1992 | Novick | 271/187 |

*Primary Examiner*—Eugene H. Eickholt
*Attorney, Agent, or Firm*—Kenyon & Kenyon

[57] ABSTRACT

An apparatus and method for delivering printed products in a rotary printing press is disclosed. Printed products are gripped by a gripping means on a paper-conducting cylinder and transferred to a fan wheel having a plurality of fan-wheel discs defined by a plurality of fan blades. The fan blades remove the printed products directly from the circumferential surface of the paper-conducting cylinder. As the printed products are removed from the paper-conducting cylinder they are guided into fan-wheel pockets formed between adjacent fan blades and slowed down.

14 Claims, 7 Drawing Sheets

APPARATUS AND METHOD FOR DELIVERING PRINTED PRODUCTS IN A ROTARY PRINTING PRESS

FIELD OF THE INVENTION

The present invention relates to an apparatus and method for delivering printed products in a rotary printing press.

BACKGROUND INFORMATION

Conventional former folders found in rotary printing presses are typically of two basic types, two-former folders and pinless former folders. The two-former type uses a gripper slow-down cylinder which delivers printed products directly to conveyor belts. The pinless former type uses high speed tapes, operating at approximately 9% above press speed, which transfers the printed products into a delivery fan which then delivers them to the conveyor belts. However, both of these folder types have operating speed limitations due to delivery system limitations. Furthermore, tape transfers often cause sheets to become skewed due to the inability of exact tape speed matches between inside and outside tapes.

U.S. Pat. No. 1,684,901 relates to a former folder having spring activatable folding rollers which permit removal of product jams occurring at high operational speeds. The folding rollers are fastened below a folding cylinder and during passage emboss a fold onto the printed products. Fan-wheel pockets receive the folded printed products which, afterwards, can be arranged on a delivery conveyor belt in shingled formation, i.e., one on top of another.

However, with this arrangement for transferring the printed products from the folding cylinder to the fan-wheel pockets, the printed products must be inserted into the middle of a nip between the folding rollers. At high production speeds, this can cause a jam to occur.

OBJECTS AND SUMMARY OF THE INVENTION

An object of the present invention is to provide for the direct transfer of printed products from a folding cylinder or paper-conducting cylinder to fan-wheel pockets without the use of strippers, intermediate rollers, or transfer tapes.

Another object of the present invention is to improve the slow down and transfer of the printed products in consecutive gradual steps without complex product transfers.

A further object of the present invention is to provide multiple delivery modules which allow printed products to be diverted into several different delivery paths.

The present invention provides an apparatus for delivering printed products in a rotary printing press, comprising: at least one paper-conducting cylinder having at least one means for gripping printed products disposed thereon; at least one fan wheel associated with the paper-conducting cylinder having a plurality of fan-wheel discs, each disc defined by a plurality of fan blades which remove the printed products directly from the circumferential surface of the paper-conducting cylinder; and fan-wheel pockets formed between adjacent fan blades which receive the printed products.

The present invention also provides a method for delivering printed products in a rotary printing press, comprising the steps of: transporting printed products to at least one paper-conducting cylinder having at least one means for gripping the printed products disposed thereon; removing the printed products directly from the circumferential surface of the paper-conducting cylinder with a plurality of fan blades of at least one fan wheel associated with the paper-conducting cylinder, the fan wheel having a plurality of fan-wheel discs defined by the plurality of fan blades; and guiding the printed products into fan-wheel pockets formed between adjacent fan blades.

The present invention further provides fan-blade tips of the fan blades which project into grooves extending along the circumferential surface of the paper-conducting cylinder. This allows a very small distance to be maintained between the fan-wheel discs and the paper-conducting cylinder. The present invention thus provides that envelope curves of the fan-wheel discs, i.e., imaginary curves formed by the tips of the fan blades, overlap with an envelope curve formed by the circumference of the respective paper-conducting cylinder. This considerably improves the operational reliability during the transfer of printed products from the circumferential surface of the paper-conducting cylinder while at the same time reducing the overall space occupied by the apparatus.

The present invention also provides a transport means urged against the circumferential surface of the paper-conducting cylinder which supports and guides the entry of the printed products into the fan-wheel pockets. The transport means supports the printed products on one side while the paper-conducting cylinder supports them on the other side. This dual support prevents the spreading or opening up of the edges of the printed products. Furthermore, it enables the printed products taken from the circumferential surface of the paper-conducting cylinder to completely enter the corresponding fan-wheel pockets while being slowed down.

The present invention further provides a pressure-applying means which adjustably urges the transport means against the circumferential surface of the paper-conducting cylinder. This has the advantage of allowing precise adjustment of the transport means according to the thickness of the printed products being processed.

The present invention also provides a delivery module having at least one fan wheel and delivery belts assigned to a paper-conducting cylinder. This has the advantage of allowing certain printed products to be directed to a further processing path.

Finally, the present invention provides a conveyor belt system equipped with diverters which can direct printed products into multiple paper-conducting cylinders. This has the advantage that several delivery modules, which can be situated below each other, can be fed by one conveyor belt system. Thus, a parallel multi-flow delivery of printed products is possible.

Other advantages and characteristics of the apparatus and method of the present invention will become apparent in view of the following detailed description and drawings.

DETAILED DESCRIPTION

Figure 1:
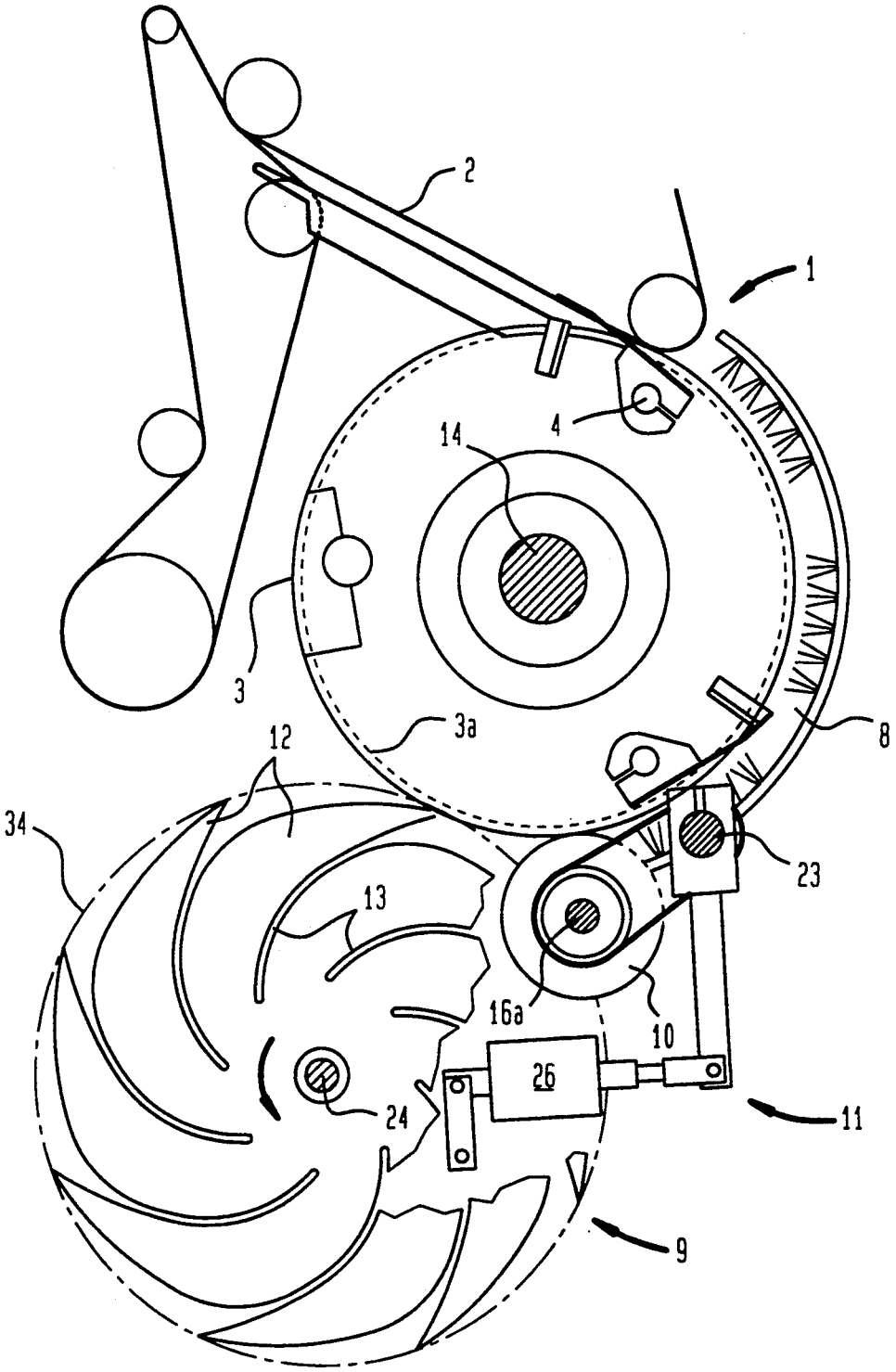
FIG. 1 is a side view of a preferred embodiment of the present invention.

FIG. 1 shows a preferred embodiment of the present invention. A conveyor belt system I transports printed products 2 to a paper-conducting cylinder 3. A means for gripping the printed products 2 comprising several gripper bars 4 arranged on the periphery of the paper-conducting cylinder 3 receives the printed products 2. As better seen in FIG. 2, a means for controlling the gripping and releasing of the printed products 2 activates the gripper means. Preferably, the gripper bars 4 being activate by a pivot lever 5, accept a roll 6, which diverts into a cam 7. Guide brushes 8 arranged on the periphery of the paper-conducting cylinder 3 guide the printed products 2 while preventing their release, especially at high operational speeds.

Figure 2:
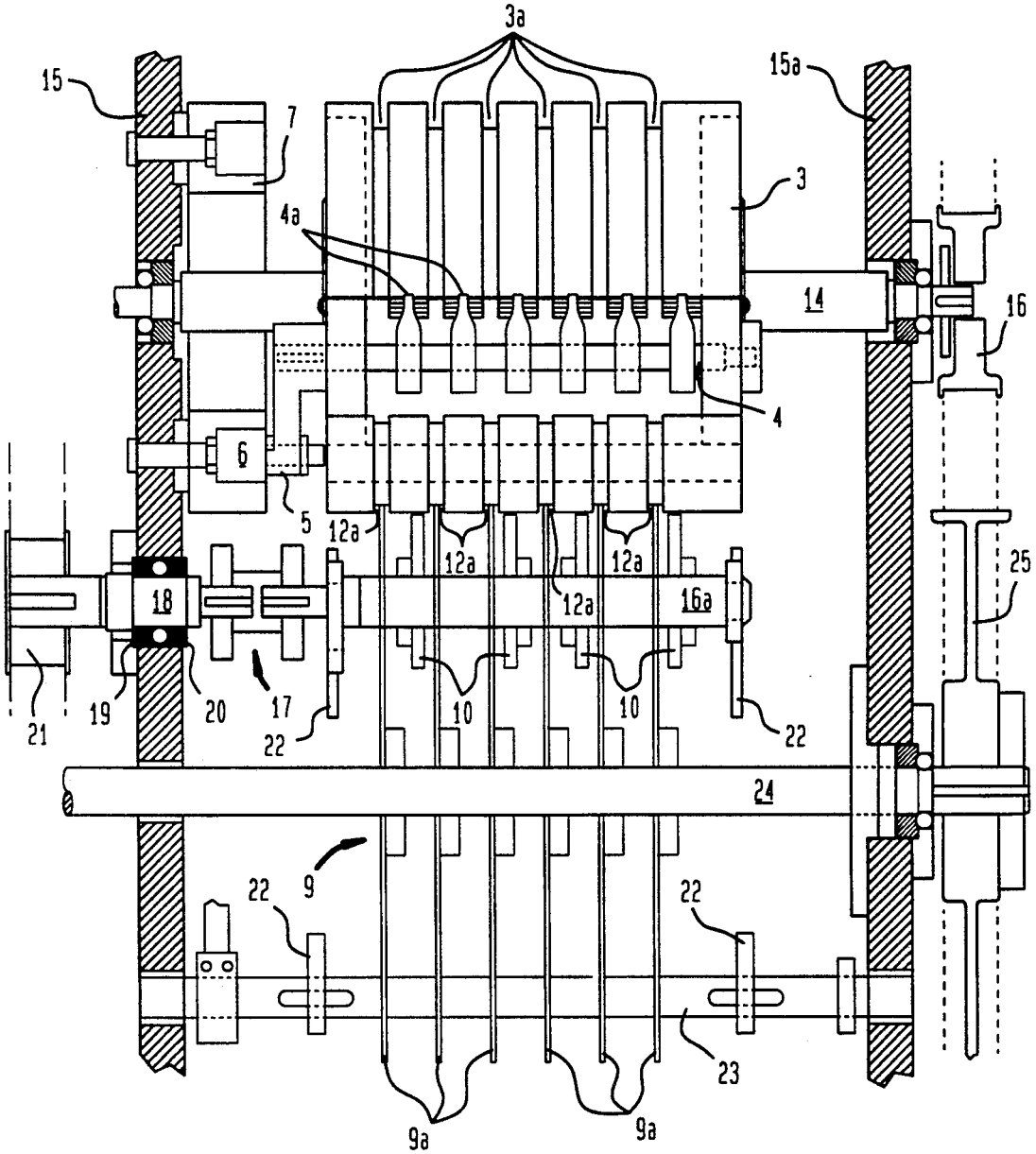
FIG. 2 is a front view of the apparatus in FIG. 1.

A means for transporting the printed products 2, preferably transport rollers 10 mounted on a shaft 16*a*, transfers the printed products 2 from the conducting cylinder 3 to a fan wheel 9 having a plurality of fan-wheel discs 9*a* fastened to a shaft 24, as shown in FIG. 2. A means for applying pressure comprising a lever mechanism 11 urges the transport rollers 10 against the circumferential surface of the paper-conducting cylinder 3 as shown in FIG. 1. The lever mechanism 11 applies pressure to the transport rollers 10 according to the thickness of the printed product being processed. Furthermore, the lever mechanism 11 can disengage the transfer rollers 10 completely from the surface of the paper-conducting cylinder 3, for example to remove a product jam should one occur. Or when not required at higher speeds.

After the printed products 2 pass the region where the transport rollers 10 contact the circumferential surface of the paper-conducting cylinder 3, fan blades 12 of the fan-wheel discs 9*a* take up the leading edges of the printed products 2. Fan-blade tips 12*a* of each fan blade 12 are inserted into grooves 3*a* which extend along the circumferential surface of the paper-conducting cylinder 3, as shown in FIG. 2. An envelope curve 34 of the fan wheel 9 and the circumference of the paper-conducting cylinder 3 overlap each other. The leading edges of the 30 printed products 2 are held by grippers 4*a*, while the fan-blade tips 12*a* drive into the space between single grippers 4*a* mounted on the gripper bar 4, thereby guiding the leading edges of the printed products 2.

The transport rollers 10 support the complete transfer of the printed products 2 into a fan-wheel pocket 13 in the fan wheel 9 formed between adjacent fan blades 12.

During this transfer, the transport rollers 10 support the printed products 2 on one side while the surface of the paper-conducting cylinder 3 supports them on the other side. This dual support prevents the edges of the printed products 2 from spreading or opening up, and from the pressure applied by the lever mechanism 11 the transport rollers 10 compress the printed products 2 to permit the escape of enclosed air. Thus, the printed products 2 are completely supported throughout their transfer.

The printed products 2, guided by the fan blades 12 are completely inserted into the fan-wheel pockets 13. This is accomplished by the transport rollers 10 during the rotational movement of the respective paper-conducting cylinder 3 and of the corresponding fan wheel 9. Dependent on product size, thickness and quality, alternate fan-wheel pockets 13 can remain empty, i.e., during production mode collecting, for example. When the printed products 2 have been completely inserted into the fan-wheel pockets 13, they are transferred in shinged formation to further processing units via delivery belts.

FIG. 2 shows the front view of the preferred embodiment of the present invention. The paper-conducting cylinder 3 is mounted on a shaft 14 supported in sidewalls 15 and 15*a*. The paper-conducting cylinder 3 is driven via a belt pulley 16. On the left sidewall 15, the cam 7 in which the roll 6 circulates, determines the time of opening and closing of the grippers 4*a* on the gripper bars 4.

The transport rollers 10 are arranged side by side on the shaft 16*a* below the paper-conducting cylinder 3. The shaft 16*a* is coupled to a drive shaft 18 by means of a flexible coupling 17 having torsional strength. The drive shaft 18 is supported in the sidewall 15 by means of two bearings 19, 20 and is driven via a belt pulley 21.

The lever mechanism 11 regulates the pressure applied to the transport rollers 10. With the help of the arms 22 and the axis 23, the shaft 16*a* can be adjusted. The transport rollers 10 rotate between the individual fan-wheel discs 9*a*. This allows adjustment of the transport rollers 10 according to product width. The shaft 24 is driven by a belt pulley 25 which has a considerably larger diameter than that of the belt pulleys 16 and 21.

The lever mechanism 11 comprises an actuating cylinder 26 with which the position and alignment pressure of the transport rollers 10 can be adjusted, as shown in FIG. 1. FIG. 2 shows how the fan-blade tips 12*a* of the fan blades 12 project into the circular grooves 3*a* on the surface of the paper-conducting cylinder 3 without touching the same. This saves space and increases the operational reliability during the transfer of the printed products. Additionally, the circular grooves 3*a* create an air cushion below the printed products 2 being gripped by grippers 4*a*. This eases the removal of the printed products 2 from the surface of the paper-conducting cylinder 3.

Figure 3:
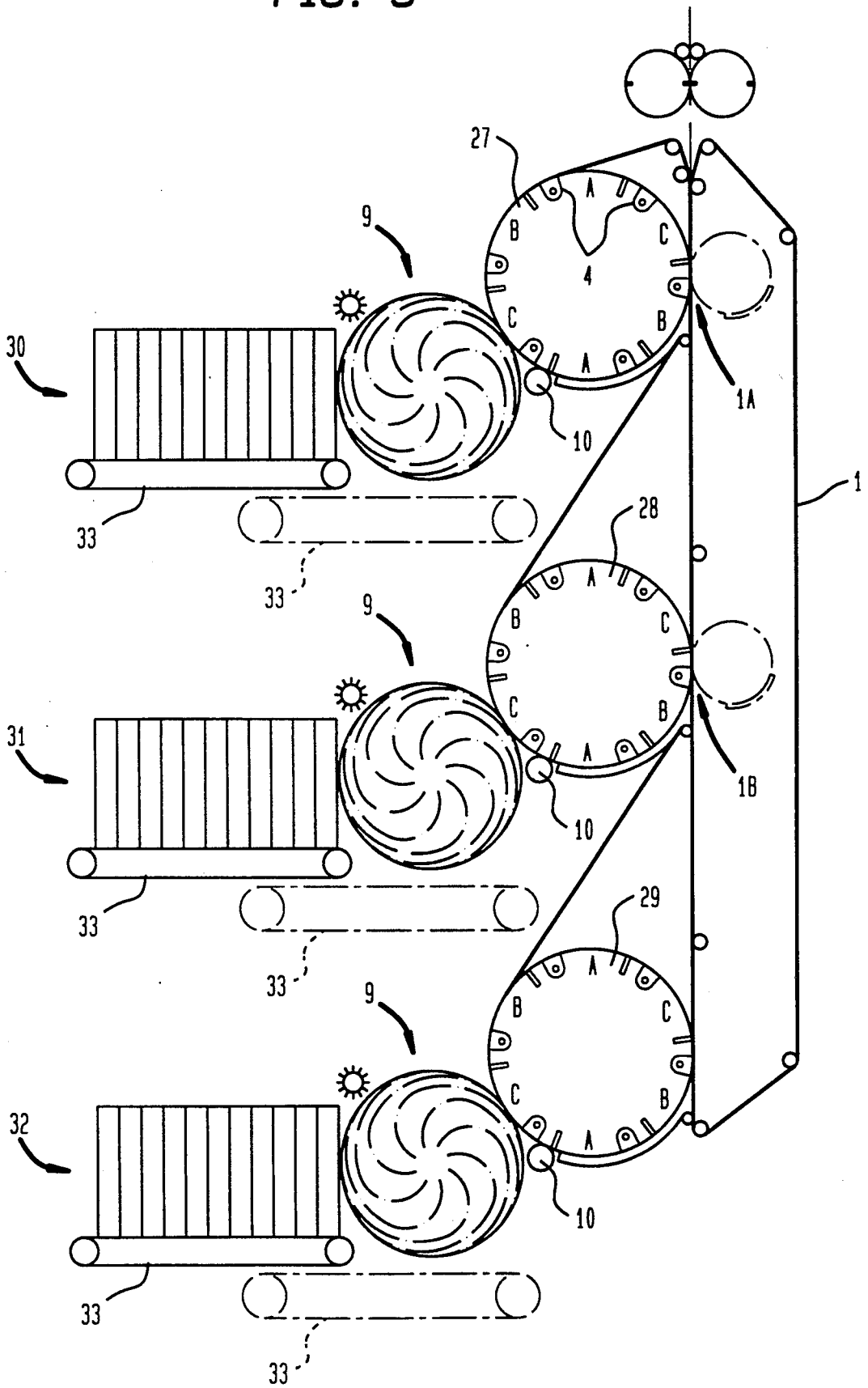
FIG. 3 is a modification of the preferred embodiment of the present invention showing several delivery modules arranged one below the other.

A modification of the preferred embodiment of the present invention is shown in FIG. 3. Several delivery modules are arranged, one below the other. In this arrangement, several different types of printed products 2 can be laid out. The printed products 2 are cut and transported through the conveyor belt system 1 to one of three paper. conducting cylinders 27, 28 or 29. The paper-conducting cylinders 27, 28 and 29 can be adjusted for various operational modes. In this arrangement, the gripper bars 4 of the uppermost paper-conducting cylinder 27 are set in such a way, that they grip every third printed product 2 from the flow of printed products 2. The paper-conducting cylinders 28 and 29 arranged below, can be timed in such a way, that every second printed product 2, and third printed product 2, respectively, can be taken from the flow of printed products 2 and can be guided into the fan wheels 9 provided thereafter, and finally placed onto delivery belts 33.

This modification of the preferred embodiment of the present invention also provides that all printed products 2 can be diverted to the upper paper-conducting cylinder 27 having six gripper bars 4. In this case, the lower delivery modules 31, 32 would be decoupled from the drive line.

The delivery of certain printed products 2 to a certain module of the delivery modules 30, 31 and 32 can be accomplished via diverters 1A and 1B provided within the conveyor belt system 1. Thus, according to production requirements a plurality of production modes are feasible. As mentioned above, transport rollers 10 are assigned to each of the paper-conducting cylinders 27, 28 and 29 to support the complete insertion of the printed products 2 into the fan-wheel pockets 13.

As shown in this arrangement, the delivery modules 30, 31 and 32 each comprise of a paper-conducting cylinder 27, 28 or 29, transport rollers 10, fan wheels 9 and delivery belts 33. If a paper-processing apparatus is limited only to two production modes, its capacity can easily be extended by adding additional delivery modules. The conveyor belt system 1, in this case, has to be suitably extended, and the required number of additional delivery modules has to be installed.

Figure 4:
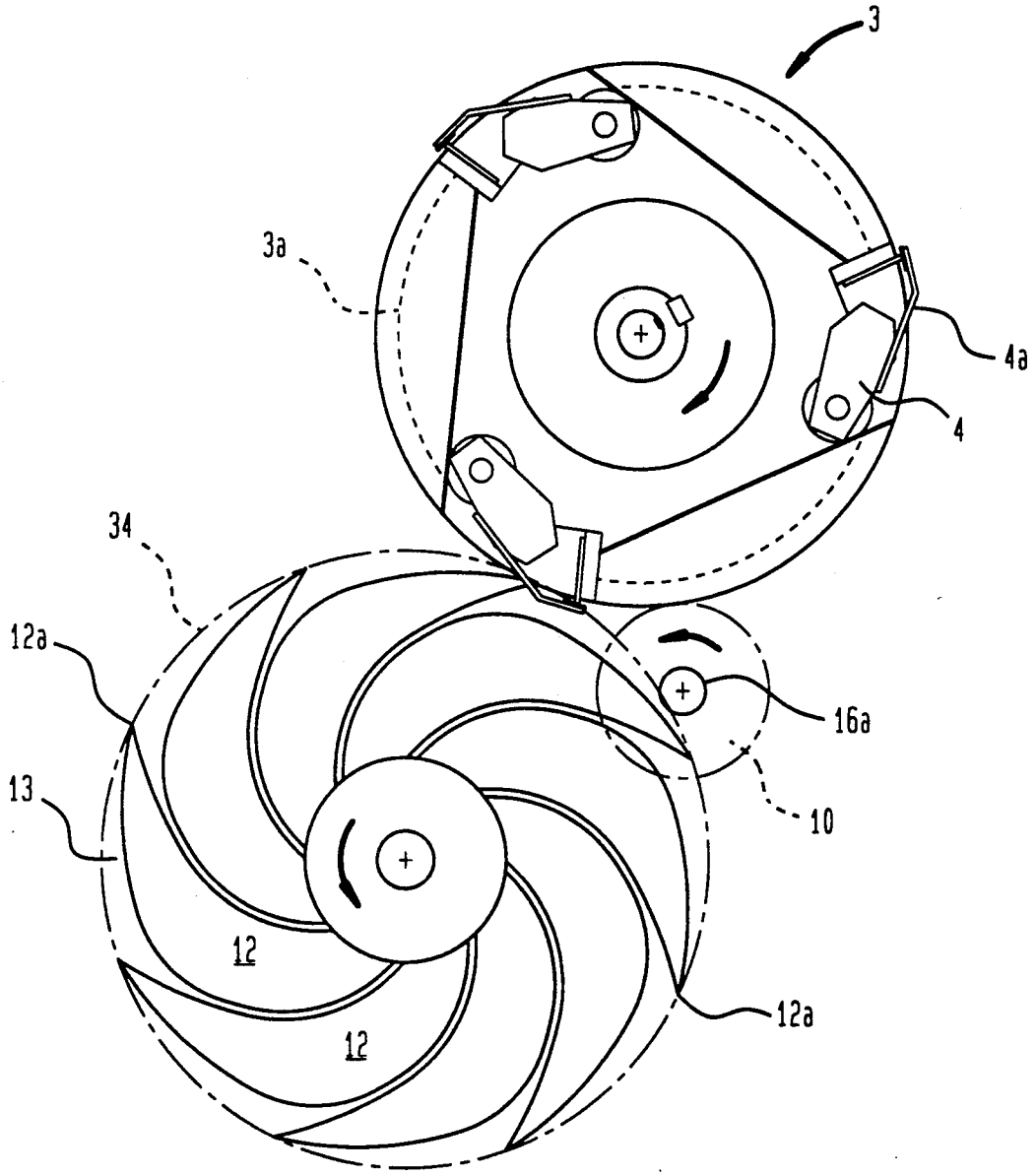
FIG. 4 shows the overlapping of an envelope curve of a fan wheel with the circumference of a paper-conducting cylinder.

FIG. 4 showing a fan wheel assigned to the paper-conducting cylinder 3, as already illustrated in FIG. 1, clearly shows the overlapping of the envelope curve 34 with the circumference of the paper-conducting cylinder 3. The fan-blade tips 12*a* are also shown projecting into the grooves 3*a* which extend along the circumferential surface of the paper-conducting cylinder 3. As they engage the leading edges of the printed products 2, the fan-blade tips 12*a* remove the printed products 2 from the surface of the paper-conducting cylinder 3, and guide them into the corresponding fan-wheel pockets 13, thereby slowing down the printed products 2.

Figure 5:
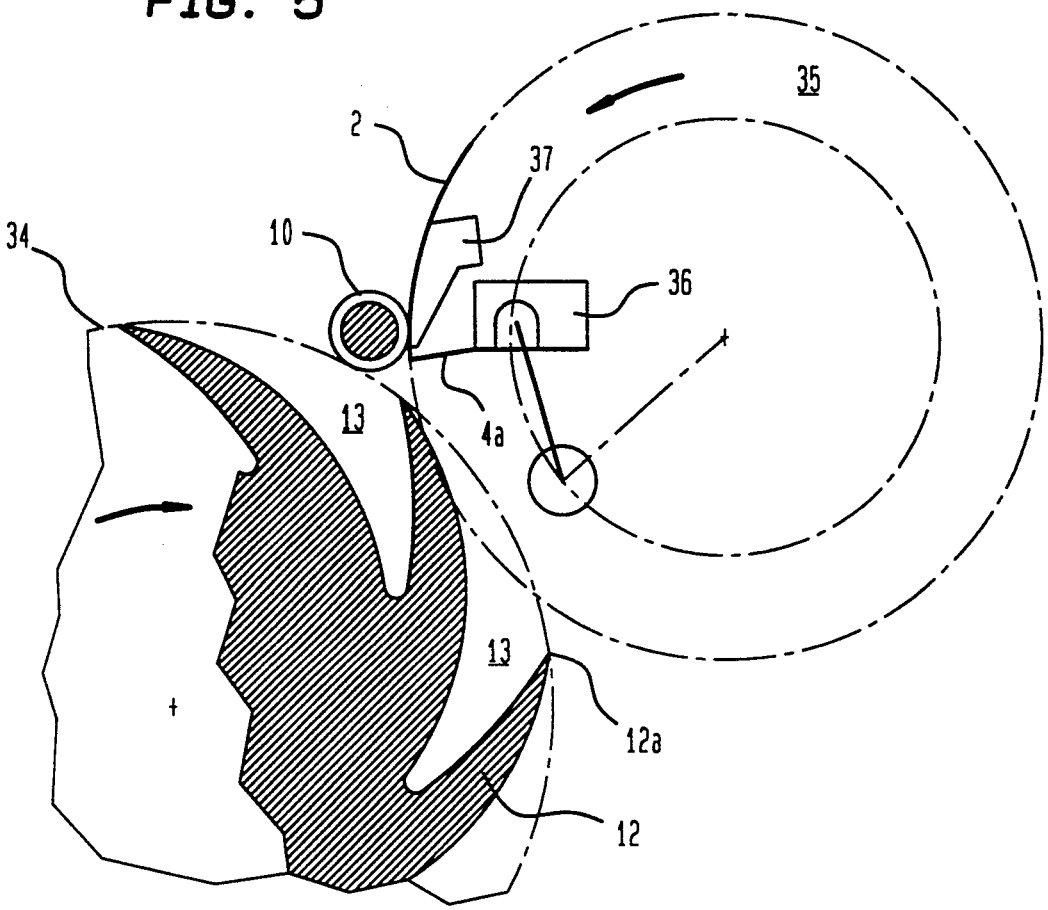
FIG. 5 shows a gripping/folding apparatus for a paper-conducting cylinder.
Figure 5A:
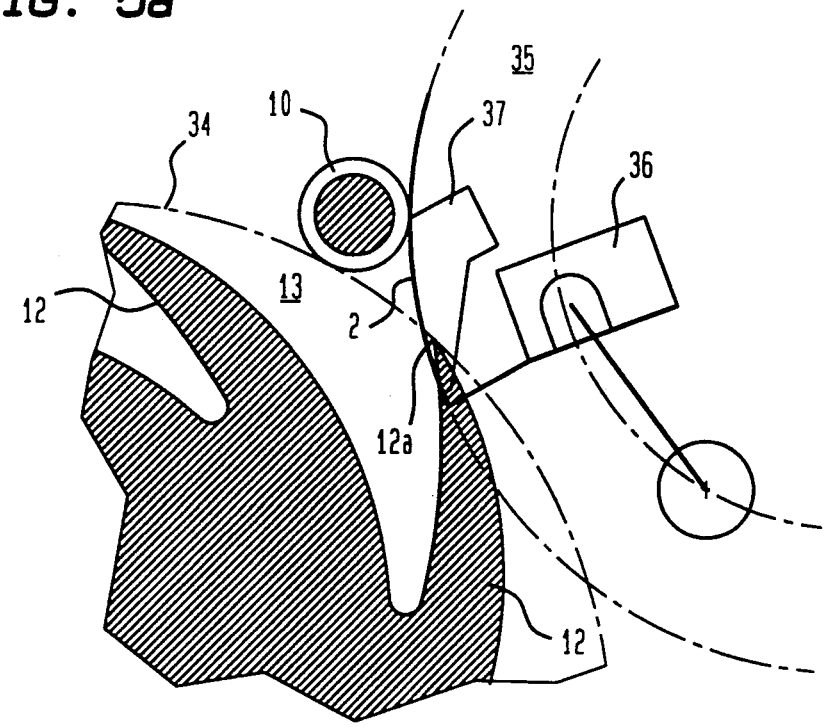
FIGS. 5*a, b, c, d,* and e show different stages of a printed product as it enters a fan-wheel pocket of a fan wheel.

FIG. 5 shows a means for gripping printed products 2 disposed on paper-conducting cylinder 35, and FIGS. 5*a, b, c, d* and *e* show different stages of the printed product 2 as it enters the fan-wheel pocket 13. The paper-conducting cylinder 35, built as a jaw cylinder within a folding apparatus, has on its circumference several jaws 37. These jaws 37 work together with movable jaw members 36. The movable jaw members 36 are controlled by the cam activated roller mechanism corresponding to reference numerals 5, 6 and 7 above. In this example, the direction of rotation of the paper-conducting cylinder 35 and the assigned fan wheel 9 is opposite to the direction of rotation of the paper-conducting cylinders and fan wheels shown in FIGS. 1 to 4.

FIG. 5*a* shows a printed product 2 gripped between the movable jaw member 36 and the jaw 37 of the paper-conducting cylinder 35. At the instant shown, the movable jaw member 36 releases the printed product 2. The fan-blade tip 12*a* moves below the leading edge of the printed product 2, guiding the leading portion of the printed product into the fan-wheel pocket 13. The transfer and support of the printed product 2 is maintained by the transport rollers 10 which are pressure adjusted onto the surface of the paper-conducting cylinder 35. As mentioned above, the envelope curve 34 overlaps with the circumference of the paper-conducting cylinder 35.

Figure 5B:
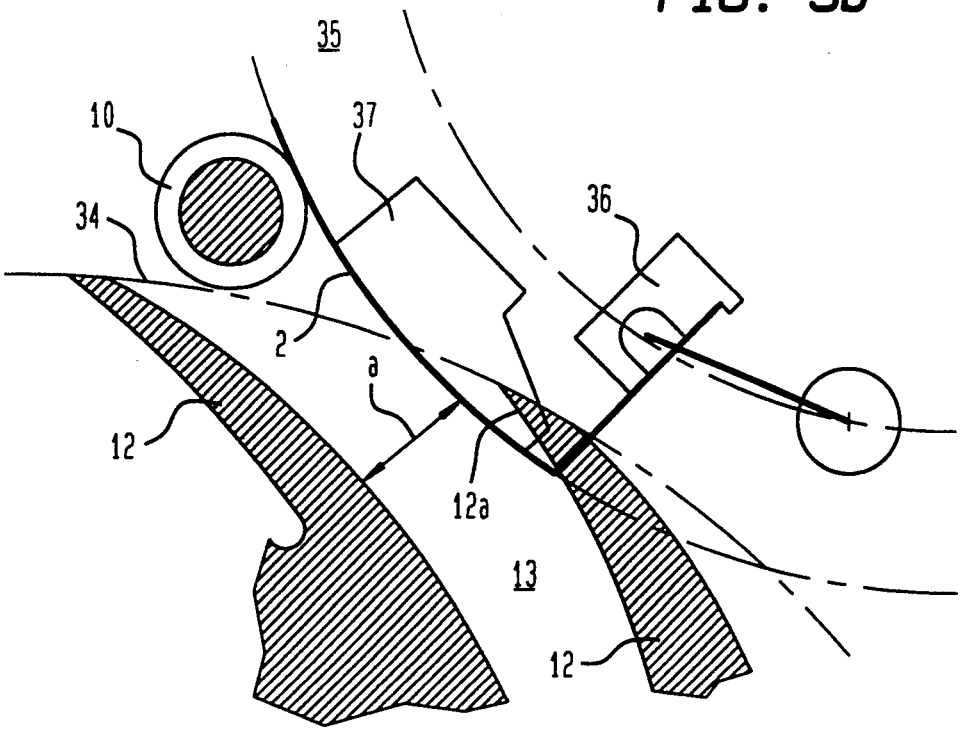
Figure 5C:
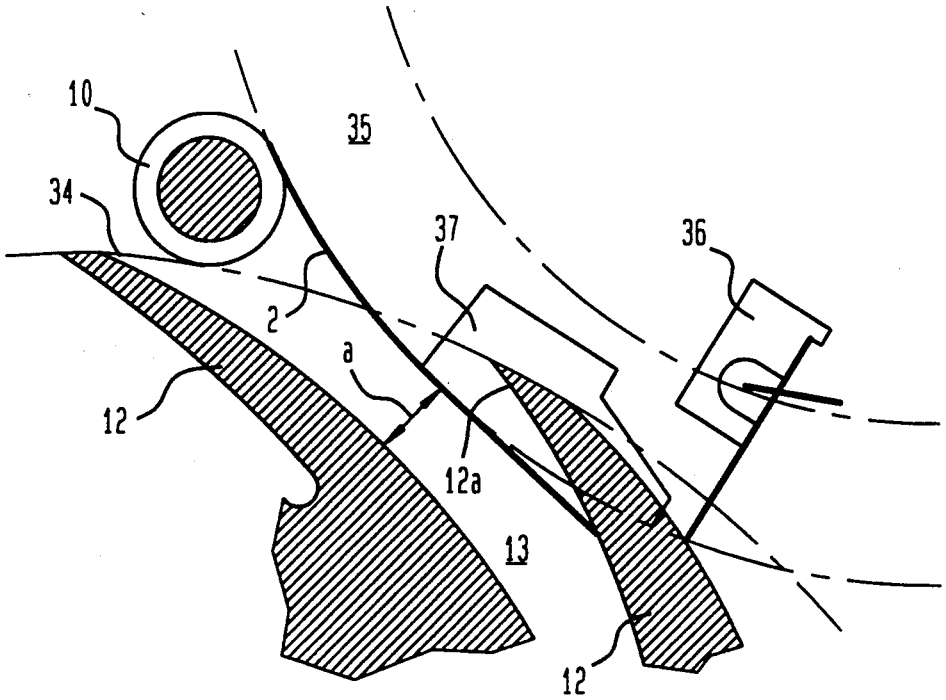

FIGS. 5*b* and 5*c* show further stages of the delivery of the printed product 2 into the fan-wheel pocket 13. FIG. 5*c* shows the instant the entrance of the printed product 2 into the fan-wheel pocket 13 is completed via transport rollers 10.

Figure 5D:
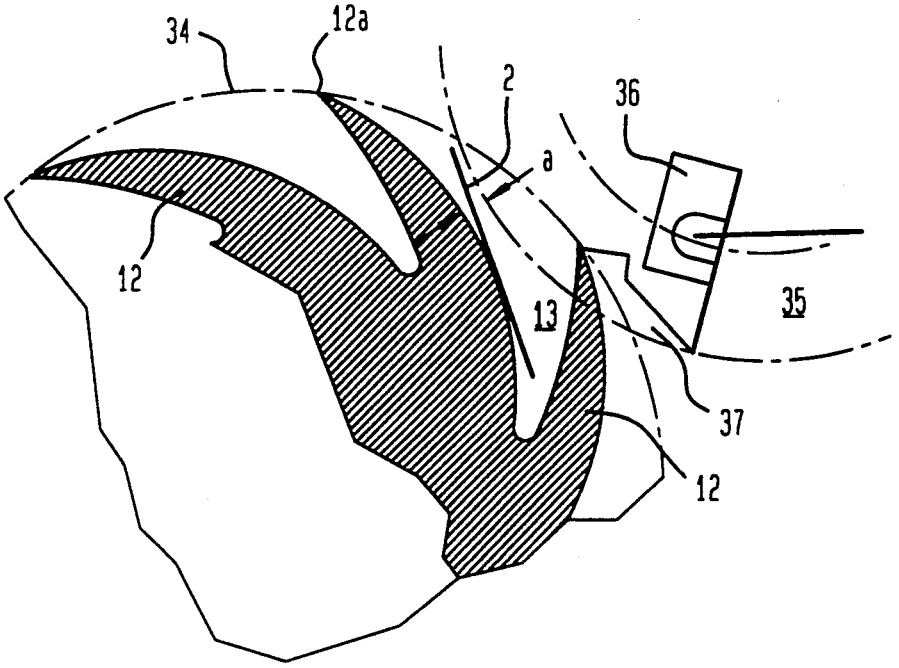
Figure 5E:
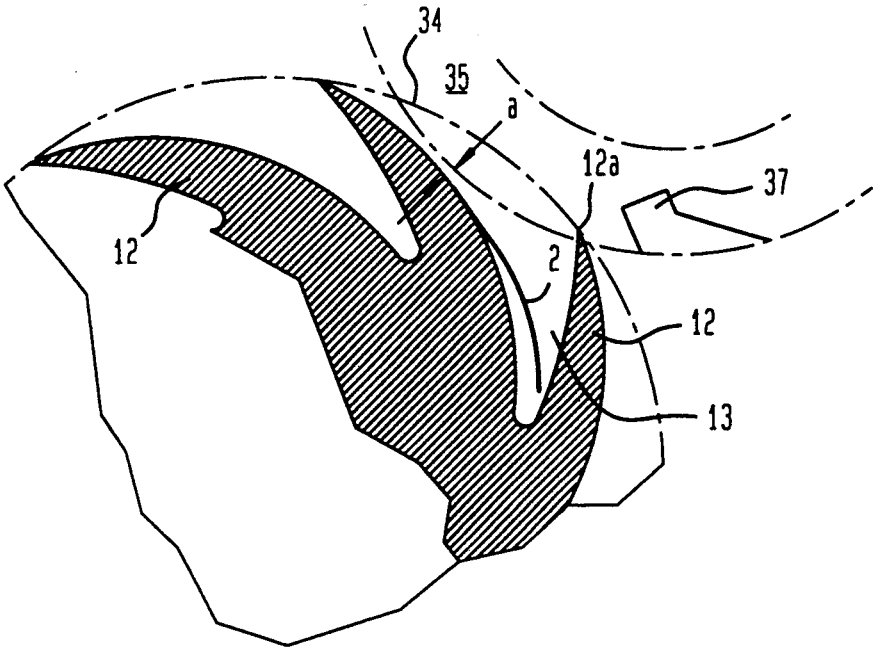

FIG. 5*d* shows the printed product 2 moving against the outer edge of the fan blade 12. FIG. 5*e* shows the printed product 2 just prior to reaching the bottom of the fan-wheel pocket 13. As the printed product 2 is further inserted into the fan-wheel pocket 13, the distance a becomes smaller and smaller, preventing the edges of the printed product 2 from spreading or opening up.

We claim:

1. An apparatus for delivering printed products in a rotary printing press, comprising:

at least one paper-conducting cylinder having at least one means for gripping printed products disposed thereon;

at least one fan wheel associated with the paper-conducting cylinder having a plurality of fan-wheel discs, each disc defined by a plurality of fan-blades which remove the printed products directly from the circumferential surface of the paper-conducting cylinder; and fan-wheel pockets formed between adjacent fan blades which receive the printed products.

2. The apparatus according to claim 1, wherein fan-blade tips of the fan blades project into grooves extending along the circumferential surface of the paper-conducting cylinder.

3. The apparatus according to claim 2, further comprising a means for transporting the printed products which supports and guides the printed products as they are conveyed into the fan-wheel pockets.

4. The apparatus according to claim 3, further comprising a pressure-applying means for urging the transporting means against the circumferential surface of the paper-conducting cylinder.

5. The apparatus according to claim 4, further comprising guide brushes arranged on the periphery of the paper-conducting cylinder for guiding the printed products while preventing their release.

6. The apparatus according to claim 5, further comprising a means for controlling the gripping and releasing of the printed products by the gripping means.

7. The apparatus according to claim 6, further comprising delivery belts for transporting the printed products away from the fan wheel.

8. The apparatus according to claim 7, further comprising a conveyor belt system having at least one diverter for directing printed products into a plurality of delivery modules.

9. The apparatus according to claim 1, wherein the linear speed of the paper-conducting cylinder exceeds the linear speed of the fan wheel.

10. A method for delivering printed products in a rotary printing press, comprising the steps of:

transporting printed products to at least one paper-conducting cylinder having at least one means for gripping the printed products disposed thereon;

removing the printed products directly from the circumferential surface of the paper-conducting cylinder with a plurality of fan blades of at least one fan wheel associated with the paper-conducting cylinder, the fan wheel having a plurality of fan-wheel discs defined by the plurality of fan blades; and guiding the printed products into fan-wheel pockets formed between adjacent fan blades.

11. The method according to claim 10, wherein a plurality of fan-blade tips of the fan blades project into grooves extending along the circumferential surface of the paper-conducting cylinder.

12. The method according to claim 11, further comprising the step of slowing down the printed products as they are transferred from the paper-conducting cylinder to the fan wheel and guided into the fan-wheel pockets.

13. The method according to claim 12, further comprising the step of supporting and guiding the printed products as they are transferred from the paper-conducting cylinder to the fan wheel.

14. The method according to claim 10, wherein the linear speed of the paper-conducting cylinder exceeds the linear speed of the fan wheel.

* * * * *